United States Patent [19]

Raschle

[11] 3,999,364

[45] Dec. 28, 1976

[54] DEVICE FOR FALSE-TWIST TEXTURING OF TEXTILE FILAMENTS

[75] Inventor: Josef Raschle, Butschwil, Switzerland

[73] Assignee: Heberlein & Co. AG, Wattwil, Switzerland

[22] Filed: Apr. 23, 1975

[21] Appl. No.: 570,781

[30] Foreign Application Priority Data

Apr. 29, 1974 Switzerland ..... 5825/74

[52] U.S. Cl. ..... 57/77.45; 57/103; 74/206; 74/210

[51] Int. Cl.[2] ..... D02G 1/06; D01H 1/24

[58] Field of Search ..... 57/77.3–77.45, 57/92, 102, 103; 74/203, 204, 210, 206

[56] References Cited

UNITED STATES PATENTS

| | | | |
|---|---|---|---|
| 3,058,289 | 10/1962 | Raschle | 57/77.45 |
| 3,348,370 | 10/1967 | Gassner | 57/77.45 |
| 3,578,751 | 5/1971 | Kodaira et al. | 57/77.45 |
| 3,747,315 | 7/1973 | Paget | 57/77.45 |

*Primary Examiner*—John Petrakes
*Attorney, Agent, or Firm*—Larson, Taylor and Hinds

[57] ABSTRACT

Devices for false-twist texturing textile filaments are described wherein a twist tube is rotated while magnetically held in a wedge shaped gap between a driven roller and a supporting roller which is rotated by power transmitted thereto predominantly by a rotary driving member in frictional contact with the two rollers. This driving member may be a cylindrical pin in the wedge shaped gap opposite that containing the twist tube and held in the gap by magnetic attraction or repulsion. Alternatively the driving member may be a roller mounted freely to rotate about its axis in frictional contact with roller surfaces on shafts carrying the driving and supporting rollers.

1 Claim, 7 Drawing Figures

DEVICE FOR FALSE-TWIST TEXTURING OF TEXTILE FILAMENTS

FIELD OF THE INVENTION

This invention relates to devices for false-twist texturing textile yarns passing through twist tubes.

DESCRIPTION OF THE PRIOR ART

The development of false-twist texturing textile filaments tends to achieve higher and higher revolution speeds of the twist tubes so as to increase yarn advance speed and thereby the production quantity of textured yarns. False-twist devices are already known which comprise, in the wedge shaped gap between axially parallel rollers, twist tubes in tangential contact with the rollers, one of the rollers being driven and the other idling as a guide-roller and in which the twist tubes are pressed against the rollers by means of magnets.

In an embodiment of this known device, the rollers each consist of two parallel discs kept apart by a spacer sleeve, the spacing being the same for each pair of discs, and magnetic attraction is effected by means of a permanent magnet which is arranged between the discs of the two rollers and the two spacer sleeves.

With this known false-twist device, it is already possible to achieve several hundred thousand revolutions per minute. If the revolution speed is further increased, however, difficulties may arise. If the twist tube is driven by the drive rollers, in the sense of rotation in which it is pushed into the wedge shaped gap between the drive rollers, this produces a further attraction force which is added to the magnetic attraction. If however, for reversing the direction of the false-twist to be imparted to the yarn, the sense of rotation of the drive-roller is reversed, the twist tube is pulled out of the wedge shaped gap by the drive roller, i.e. a force is produced which tends to remove the twist tube from the gap, which is increased as the friction resistance of the non-driven supporting roller increases. Thereby, the effect of the magnetic attraction is reduced, and, with extremely high revolution speeds, the safe pressing of the twist tube towards the rollers is no longer completely assured because of the strong centrifugal forces produced. Furthermore, variations of the twist tube revolution speeds may occur which exceed the tolerances admissible in the technique of yarn texturing.

SUMMARY OF THE INVENTION

It is the purpose of the present invention to provide a false-twist device with which it is possible to achieve a further essential increase of the twist tube revolution speed without the aove-mentioned disadvantages occurring in the known devices.

Accordingly, the object of the present invention is achieved by a device for false-twist texturing of textile filaments, comprising two axially parallel rollers rotatable about their axes, one of which is driven, at least one twist tube supported in the wedge shaped gap therebetween in tangential contact and a permanent magnet pressing the twist tube towards the rollers, the device being characterized in that, between the two axially parallel rollers or respectively between further rollers arranged on their shafts, there is provided a member in frictional contact with the two rollers for transmitting the force from the driven roller to the other roller.

In the device according to the present invention, it is assured that a force transmission from the driven roller to the guide roller is effected and that this force transmission must not be assumed by the twist tube itself. The twist tube does therefore not absorb more energy than necessary for imparting twist to the yarn, and therefore, no inadmissible variations of the twist tube revolution speed are observed. Furthermore, the force which tends to lift off the twist tube from the rollers is considerably reduced because of the essentially lower friction resistance of the driven support roller.

DESCRIPTION OF THE DRAWING

In order that the invention may be clearly understood and readily carried into effect, devices in accordance therewith will now be described by way of example, with reference to the accompanying drawings, in which.

Figure 1:
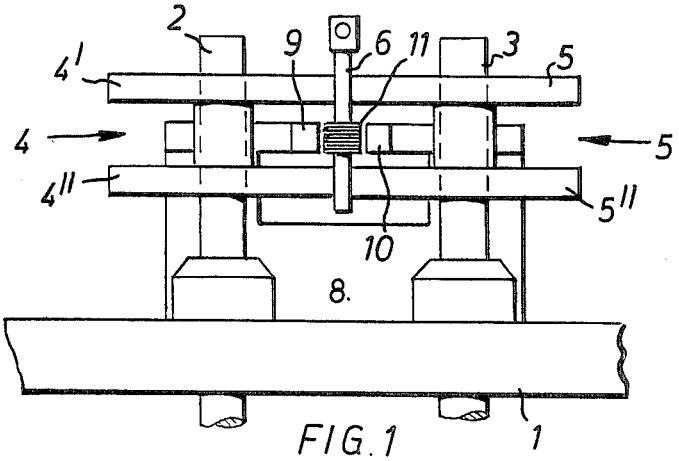
FIG. 1 shows a front elevation of a false-twist texturing device.
Figure 2:
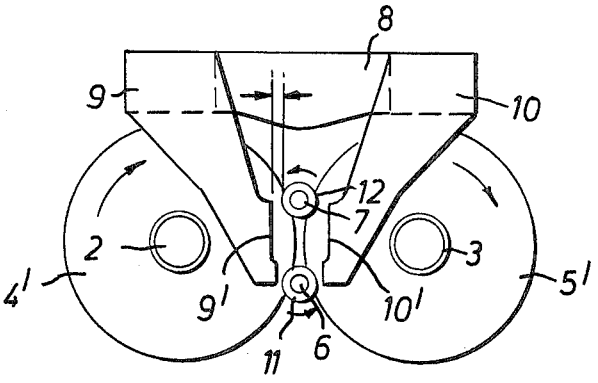
FIG. 2 shows a plan view of the device of FIG. 1.

The device according to FIGS. 1 and 2 comprises a support plate 1 on which vertical shafts 2 and 3 are arranged in bores. On shafts 2 and 3, there are provided rollers 4 and 5, each of which consists of two discs 4′, 4″ and 5′, 5″ which are kept apart by spacer sleeves. Each disc is provided with a rim of polyurethane synthetic material. In a wedge shaped gap formed between the discs 4′, 4″ and 5′, 5″, a twist tube 6 is supported in parallel relationship with the roller shafts, and in the other wedge shaped gap, there is supported a metal pin 7, also in parallel relationship with the roller shafts. The twist tube 6 and the pin 7 are pressed towards the discs 4′, 4″ and 5′, 5″ by means of a horse-shoe magnet, the U-shaped plane of which extends vertically and at the ends of its limbs there are provided flat, horizontally extending pole pieces 9, 10. The twist tube 6 and pin 7 each comprise an enlarged central cylindrical portion 11, 12 which consists of a pack of low-loss magnetic material in the form of laminations. The twist tube 6 and pin 7 as well as their central portions 11, 12 have the same external diameters. The pole pieces 9, 10 extend into the space between the discs 4′, 4″ and 5′, 5″ and their terminal faces 9′, 10′, as shown in FIG. 2, are shaped so that the air gap between the pole pieces and the cylindrical portion 11 of the twist tube 6 is smaller than the air gap between the pole piece terminal faces 9′, 10′ and the cylindrical portion 12 of metal pin 7. One of the shafts 2, 3 is driven externally, for instance by means of a belt, and pin 7 transmits drive from the roller arranged on the driven shaft to the roller arranged on the other shaft.

Figure 3:
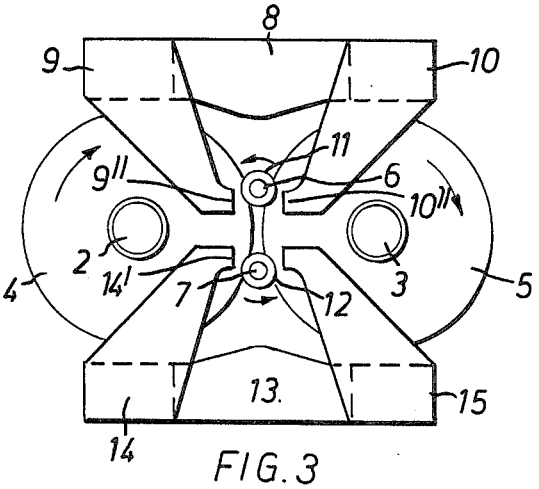
FIG. 3 shows a plan view of a second false-twist texturing device.

FIG. 3 shows an example in which the twist tube 6 and the metal pin 7 are respectively pressed towards the rollers 4, 5 by similar horse-shoe magnets 8, 13 with similar pole pieces 9, 10; 14, 15. The air gap between the pole piece terminal faces 14′, 15′ and the cylindrical portion 11 of the twist tube 6 in this case equals the air gap between the pole piece terminal faces 9′, 10′ and the cylindrical portion 12 of metal pin 7. permanent

Figure 4:
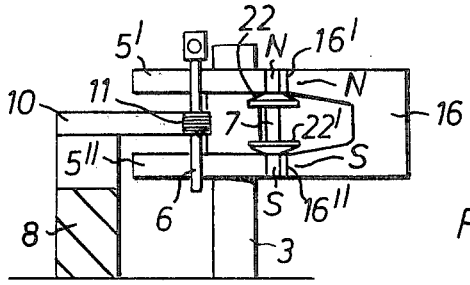
FIG. 4 shows a vertical section through a third false-twist texturing device, the section being on line A—A in FIG. 5.
Figure 5:
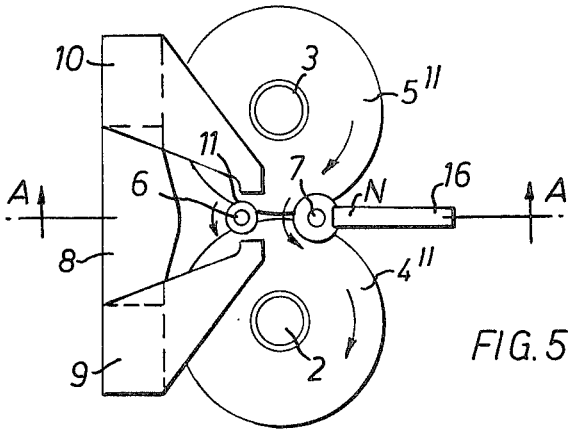
FIG. 5 shows a plan view of the device of FIG. 4.

FIGS. 4 and 5 show a device in which the twist tube 6, like that of FIGS. 1 and 2 or alternatively FIG. 3, is pressed towards the rollers 4, 5 by means of a horseshoe magnet 8 having a vertical U-shaped plane and horizontal, flat pole pieces 9, 10. The metal pin 7 on the other hand consists of a magnetic metal alloy and comprises magnetically polarized ends as well as two collars 22, 22' which prevent axial shifting of the pin. The metal pin 7 is pressed against the rollers 4, 5 by magnetic repulsion of a permanent magnet 16, the direction of polarization of which extends in parallel relationship with the metal pin 7 and presents poles 16', 16'' adjacent end of the same polarity as the polarized ends of the pin 7.

Figure 6:
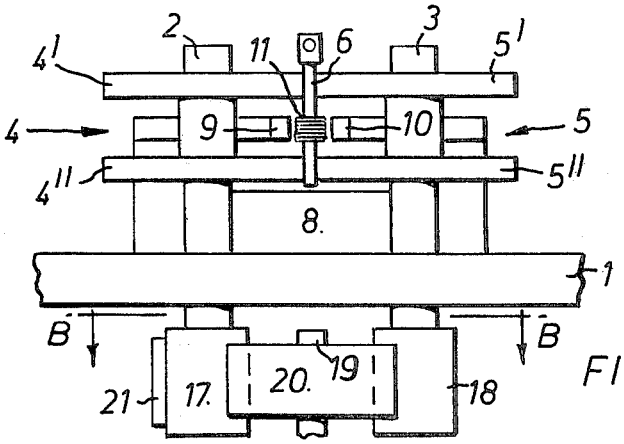
FIG. 6 shows a front elevation of a fourth false-twist texturing device.
Figure 7:
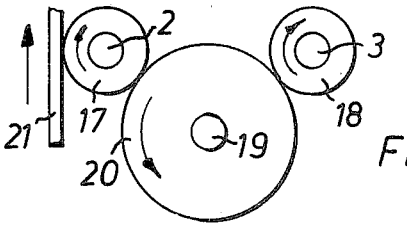
FIG. 7 shows a cross-section on line B—B in FIG. 6.

Finally, FIGS. 6 and 7 show a device in which, on each of the shafts 2 and 3, at the ends situated below the support plate 1, there are provided further rollers 17, 18 of aluminum between which there is arranged a roller 20 freely rotatable about its axis 19, made of polyurethane synthetic material, which is in frictional contact with the rollers 17, 18. The roller 17 is driven by means of belt 21. In this embodiment, if necessary, one twist tube can be supported in each of the wedge shaped gaps between the rollers 4, 5.

I claim:

1. A device for false-twisting textile yarns passing through a twist tube comprising: a twist tube formed with a cylindrical surface, two axially parallel roller units mounted to rotate about their axes, driving means to power drive one said roller, said roller units being formed with first cylindrical surfaces spaced from one another and relatively located to present two wedge shaped gaps therebetween, one said gap being adapted to receive therein said twist tube with its cylindrical surface frictionally engaging said roller unit surfaces and means for locating said twist tube in said gap, further cylindrical surfaces on said roller units displaced axially from said first cylindrical surfaces, a frictional driving member formed by a roller mounted freely to rotate about its axis in frictional engagement with said further cylindrical surfaces on said roller units.

* * * * *